United States Patent [19]

Grohoski et al.

[11] 4,067,186

[45] Jan. 10, 1978

[54] ROTATABLE CRYSTAL AND BEZEL ASSEMBLY FOR ACHIEVING SPECIAL VISUAL EFFECTS IN A TIMEPIECE

[75] Inventors: Raymond J. Grohoski, Watertown; Harwell B. Thompson, Cheshire, both of Conn.

[73] Assignee: Timex Corporation, Waterbury, Conn.

[21] Appl. No.: 751,779

[22] Filed: Dec. 17, 1976

[51] Int. Cl.[2] ..... G04B 39/00

[52] U.S. Cl. ..... 58/91

[58] Field of Search ..... 58/91

[56] References Cited

U.S. PATENT DOCUMENTS

| | | | |
|---|---|---|---|
| 1,064,770 | 6/1913 | Quinn | 58/91 |
| 1,333,194 | 3/1920 | Wachter | 58/91 |
| 2,854,815 | 10/1958 | Piquerez | 58/91 X |
| 3,030,763 | 4/1962 | Klingenberg | 58/91 X |
| 3,735,585 | 5/1973 | Takagi | 58/91 X |

FOREIGN PATENT DOCUMENTS

| | | | |
|---|---|---|---|
| 209,196 | 6/1940 | Switzerland | 58/91 |
| 297,483 | 6/1954 | Switzerland | 58/91 |
| 337,140 | 4/1959 | Switzerland | 58/91 |
| 349,544 | 11/1960 | Switzerland | 58/91 |
| 364,223 | 10/1962 | Switzerland | 58/91 |

*Primary Examiner*—Stanley J. Witkowski
*Attorney, Agent, or Firm*—William C. Crutcher

[57] ABSTRACT

In a timepiece, a supplementary watch crystal is mounted over the regular watch crystal so as to be manually rotatable with respect to the regular watch crystal. The supplementary watch crystal may then be provided with special marking indicia or constructed of special material to achieve special visual effects when used in conjunction with other devices in a timepiece such as a rotatable bezel ring or rotatable "seconds" disc with markings thereon. Modified forms of the invention include a bezel extension formed on the supplementary crystal, or a second supplementary crystal mounted on the first supplementary crystal. The supplementary crystal is preferably mounted by an inner circumferential lip on the supplementary crystal disposed in an outer circumferential groove on the regular watch crystal.

7 Claims, 4 Drawing Figures

ROTATABLE CRYSTAL AND BEZEL ASSEMBLY FOR ACHIEVING SPECIAL VISUAL EFFECTS IN A TIMEPIECE

BACKGROUND OF THE INVENTION

This invention relates to timepieces for achieving a wide variety of special visual effects in addition to telling the time in a conventional manner. More particularly, the invention pertains to a special rotatable crystal and watch bezel assembly having an improved construction for achieving a variety of changing visual patterns and color effects, display of ornamental designs or personalized information and display of different time zones, elapsed time or other useful information depending on the marking indicia, materials or scales used.

Watches for achieving special visual effects in addition to telling the time are well known in the art. Watches with manually rotatable bezel rings for providing 24-hour markings or reading the time in another time zone, or measuring elapsed time, are known. Exemplary are U.S. Pat. No. 3,271,945–Anderson, issued Sept. 13, 1966 and U.S. Pat. No. 3,553,958– Grohoski, issued Jan. 12, 1971, the latter assigned to the present assignee.

Constructions are known in which the bezel and crystal attached to the bezel are rotatable as a unit and carrying logarithmic scale indicia to provide a circular slide rule, as exemplified by U.S. Pat. No. 1,322,770–Eastwood, issued Nov. 25, 1919. Watches are known with fixed sealed crystals and transparent overlay members disposed outside of the fixed crystal which are rotatable or carry time indicating indicia, as shown in U.S. Pat. No. 2,462,839–Brown; U.S. Pat. No. 1,796,652–Hawley; U.S. Pat. No. 1,064,770–Quinn and U.S. Pat. No. 2,939,420–Hewitt. Finally, various patents are known using stationary crystals of polarized or colored material or marked with symbols or designs, which cooperate with internal discs or hands of polarized or colored material or marked with symbols or designs. These are exemplified by Swiss Pat. No. 354,031, filed Feb. 10, 1959, Swiss Pat. No. 324,755, filed May 31, 1955 and U.S. Pat. No. 3,595,009, issued July 24, 1971 to Pakter and Krauss. The possibilities for such special visual effects are virtually limitless and the present invention relates to a construction enhancing the ability to provide such special effects.

SUMMARY OF THE INVENTION

Briefly stated, the invention is practiced by providing, in a watch of the type having a regular stationary transparent crystal mounted in a watch case with time indicating rotatable members and a dial visible through the regular crystal, the improvement comprising a supplementary watch crystal mounted on and disposed outside of the regular watch crystal so as to be rotatable therewith. A manually rotatable bezel ring and/or a rotatable "seconds" disc in place of the normal "seconds" hand may be used in conjunction with the supplementary crystal. Modified forms of the invention include a bezel ring extension on the supplementary crystal, or a second supplementary crystal outside of the first supplementary crystal.

DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawing, in which:

FIG. 1 is a partial elevation drawing, in cross-section, of a timepiece, illustrating the crystal, upper case, bezel, time indicating members and dial, but omitting the conventional movement and lower case details, FIG. 2 is an enlarged elevation view in cross-section showing details of the crystal and bezel ring mounting assembly, FIG. 3 is a view similar to FIG. 2, but showing a modified form of the invention, and FIG. 4 is a view similar to FIG. 2, showing a further modification of the invention.

DESCRIPTION OF THE PREFERRED EMBODIMENT

Figure 1:
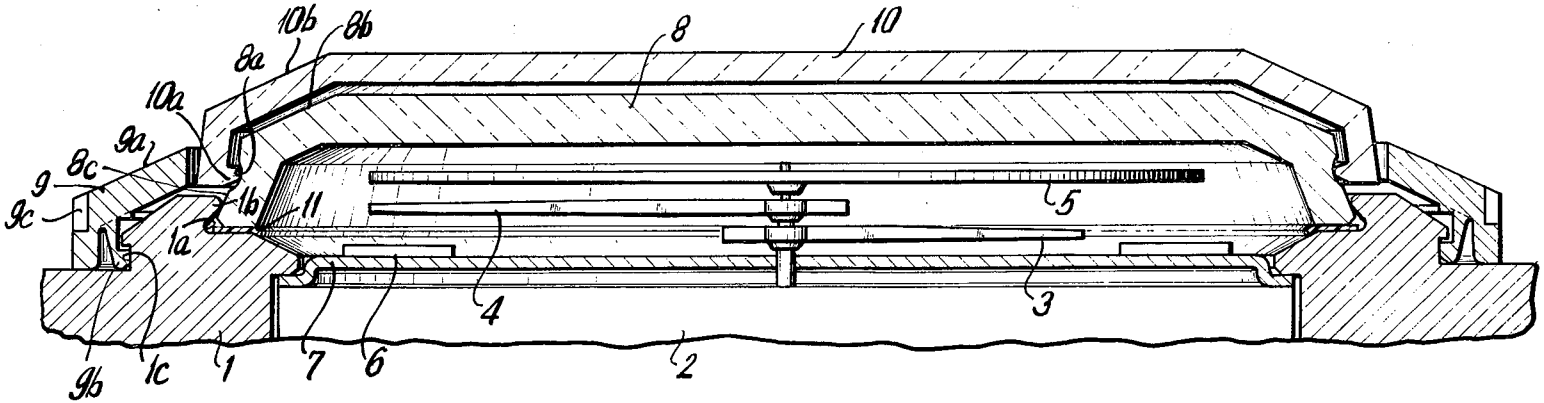

Referring to FIG. 1 of the drawing, the conventional portion of a timepiece includes a case 1 containing a movement 2 to arrange to drive an hour hand 3, a minute hand 4 and a "seconds" indicator 5. The seconds indicator in its preferred form here is a substantially transparent disc which may alternately be of polarized material, colored material, or carry special visual indicia such as scribed markings or fanciful symbols or drawings as desired. The rotating members 3, 4, 5 register with markers 6 on a dial 7 so that time can be read in the conventional manner.

The watch case 1 defines a circumferential groove 1a and an inwardly directed flange 1b which cooperates to hold the rim of a stationary transparent crystal 8 by interference fit in a known manner by pressure against the frusto-conical surface 8c. An additional ring 11 may assist resistance to entry of water, dust or moisture.

Case 1 also includes an outer circumferential groove 1c for mounting a rotatable bezel ring 9. The bezel ring 9 has an upper surface *9a* for marking visual indicia such as 24-hour scale, elapsed time, logarithmic scale, etc. The lower lip of bezel ring 9 is bifurcated to provide a flexible circumferential flange *9b* which can be deflected to snap the bezel ring into place in groove 1c and permit it to be manually rotatable with respect to the watch case 1. A knurled portion *9c* permits ease of turning the bezel ring.

In accordance with the present invention, the regular crystal member 8 serves as the mounting base for a supplementary crystal member 10 disposed outside of crystal 8 and manually rotatable thereon. A preferred form of mounting the supplementary crystal 10 is by means of an inwardly directed circumferential lip *10a* carried in a outer circumferential groove *8a* on the regular watch crystal. The crystal members 8, 10 may be formed or molded from substantially transparent plastic material such as the acrylics or polycarbonates. The crystal members 8, 10 are preferably provided with parallel frustoconical surfaces at the outer peripheries such as *8b, 10b* respectively. These may include logarithmic scales, elapsed time, or time zone indicia. Also the crystal members 8, 10 may be manufactured with polarizing plastic material, such as Polaroid No. THM 46 affixed to a crystal member whereby rotation of crystal 10 relative to crystal 8 will increase or decrease the light transmission capabilities of the combined crystals. Alternately, the inner crystal 8 or outer crystal 10 may be manufactured of polarizing material and the "seconds" disc 5 may be of polarizing material or have polarizing sections therein to provide moving or pulsating visual effects as the "seconds" disc rotates. Alternatively, pictures or symbols may be applied to any of the members 5, 8, 10 or 9 to achieve any aesthetic, personalized or functional visual effect desired.

Figure 2:
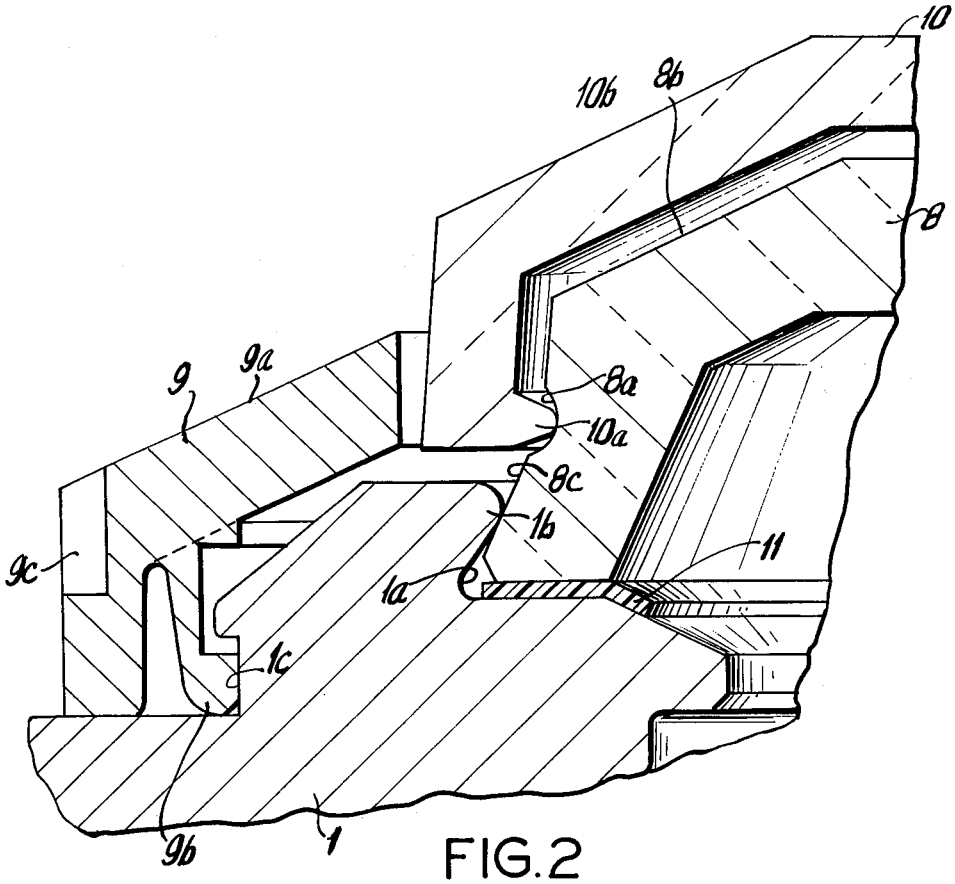
Figure 3:
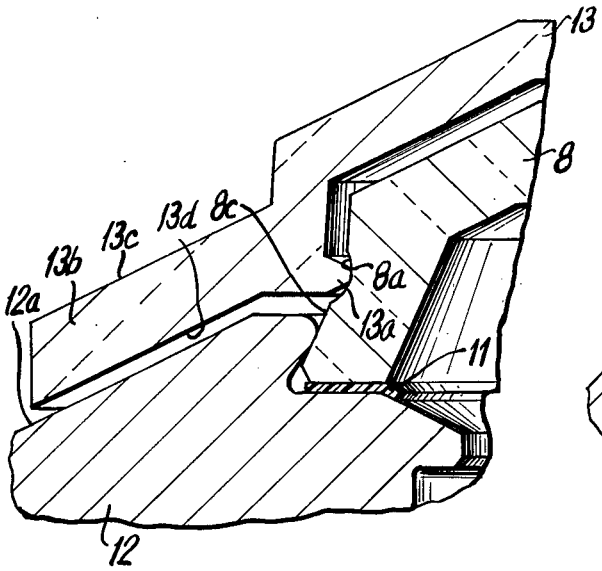

FIG. 3 shows a modified form of the invention. The regular crystal 8 is mounted in a watch case 12 in the same manner as illustrated in FIGS. 1 and 2. The case 12 is modified to include a sloping surface 12*a* on it periphery. The supplementary crystal illustrated at 13 is mounted in the same manner as before on the inner crystal by means of an inwardly directed circumferential lip 13*a* disposed in the circumferential groove 8*a* on the regular crystal. However, the supplementary crystal is also provided with a radial extension 13*b* forming a rotatable bezel ring integral with the supplementary crystal. Either the upper surface 13*c* or lower surface 13*d* of bezel extension 13*b* may carry visual indicia as before which can also register with visual indicia on surface 12*a* of the case to produce special effects or provide supplemental information.

Figure 4:
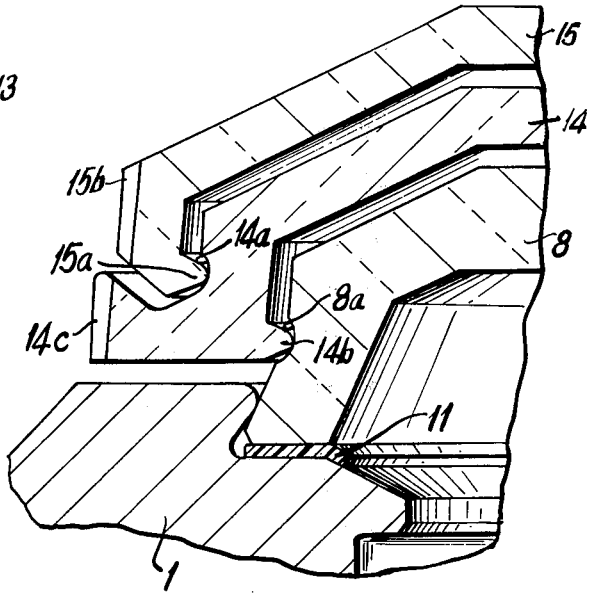

Referring to FIG. 4, a further modification of the invention is illustrated where the watch case 1 carries the regular crystal 8 in the manner described previously. A first supplementary crystal 14 is mounted by means of a lip 14*b* as before to be rotatable on regular crystal 8. However, in addition, the first supplementary crystal includes its own outer circumferential groove 14*a* to serve as the mounting for a second supplementary crystal member 15, with a inwardly directed lip 15*a* disposed in groove 14*a*. The crystal members 14, 15 may have gripping means such as knurled peripheries 14*c*, 15*b* respectively to permit rotation relative to one another and relative to the stationary crystal 8. The possibilities for achieving special effects are limited only the imagination of the designer.

Assembly of the supplementary crystal is very simple and should be readily apparent from the drawings. After assembly of the regular crystal 8 in the case, the supplementary crystal is merely snapped over it, this being enabled by the slightly frusto-conical surface 8*c* of the crystal 8 and the resiliency of the plastic material used in the crystals. The degree of ease in rotating the supplementary crystal is naturally dictated by the dimensions and materials chosen by the skilled designer.

While there have been described a preferred form and two modifications of the present invention, other modifications may occur to those skilled in the art, and it is intended to cover in the appended claims all such modifications as fall within the true spirit and scope of the invention.

We claim:

1. In a timepiece of the type having a case, a movement within the case, rotatable time indicating members driven by said movement, a dial disposed between the movement and the time indicating members for telling the time, and a regular crystal member mounted in the case and covering said time indicating members, the improvement comprising:

a supplementary crystal member disposed on the exterior of said regular crystal member and mounted thereon so as to be manually rotatable with respect thereto.

2. The combination according to claim 1, wherein said regular crystal member defines a circumferential groove in its outer surface adjacent said case and wherein said supplementary crystal member defines an inwardly directed circumferential lip disposed in said groove, whereby said groove and said lip serve to support the supplementary crystal for manual rotation with respect to the regualr crystal.

3. The combination according to claim 1, and further including a bezel ring member supported in such case for relative rotation with respect thereto and disposed radially outwardly of both of the regular watch crystal and supplementary watch crystal, said bezel ring and said watch crystals having adjacent circumferential surfaces adapted to carry visual indicia.

4. The combination according to claim 1, wherein at least one of said rotatable time indicating members is a substantially transparent disc having a surface adapted to carry visual indicia for creating special effects with respect to at least one of said crystals.

5. The combination according to claim 1, wherein said supplementary watch crystal includes a radial extension covering a circumferential portion of said watch case, said watch case portion, said radial extension having surfaces thereon adapted to receive visual indicia for producing special visual effects by relative rotation between the supplementary crystal and the case.

6. The combination according to claim 1, and further including a second supplementary crystal disposed exterior of said supplementary crystal and mounted thereon for manual rotation with respect thereto.

7. The combination according to claim 6 wherein said supplementary crystal and said second supplementary crystal have peripheral gripping means thereon arranged to facilitate relative manual rotation.

* * * * *